US005535797A

United States Patent [19]

Martindale

[11] Patent Number: 5,535,797

[45] Date of Patent: Jul. 16, 1996

[54] SYSTEM FOR ORGANIZING ARTICLES IN A PURSE

[76] Inventor: Otis L. Martindale, Rte. 1, Box 111, Grandview, Tex. 76050

[21] Appl. No.: 396,691

[22] Filed: Mar. 1, 1995

[51] Int. Cl.[6] ..... A45C 1/08

[52] U.S. Cl. ..... 150/111; 211/10; 224/245; 43/57.1

[58] Field of Search ..... 150/111, 110; 211/10, 113, 86; 224/245, 242, 249; 434/112, 113; 340/407.1; 116/200, 205, DIG. 17; 43/57.1, 54.1, 57.2

[56] References Cited

U.S. PATENT DOCUMENTS

| | | | |
|---|---|---|---|
| D. 334,661 | 4/1993 | Kohn | D3/54 |
| 1,667,676 | 4/1928 | Price et al. | 206/37.7 |
| 1,816,642 | 7/1931 | Fetter | 116/205 |
| 4,263,951 | 4/1981 | Siegel | 150/111 |
| 4,680,886 | 7/1987 | Caselli, Sr. | 43/57.1 |
| 5,067,617 | 11/1991 | Caldwell et al. | 211/113 X |
| 5,129,524 | 7/1992 | Holman | 211/113 |
| 5,440,829 | 8/1995 | Parvin | 43/57.1 |

*Primary Examiner*—Allan N. Shoap
*Assistant Examiner*—Christopher J. McDonald
*Attorney, Agent, or Firm*—Geoffrey A. Mantooth

[57] ABSTRACT

A purse has walls that form an enclosed cavity. The walls have an opening that communicates with the cavity. Inside of the cavity are plural holders. A holder can be of a variety of configurations, such as a bag, a wallet, a checkbook, a key ring, etc. Each holder is secured to a support member by a line. The support member is coupled to the purse walls and has notches formed therein, which notches are located near the purse opening. The line from each holder extends through a respective notch in the support member. The free end of the line has a stop located thereon to prevent the line from being pulled through the notch. The stops can have unique tactual and visual characteristics to help a user of the purse identify a particular holder.

20 Claims, 3 Drawing Sheets

SYSTEM FOR ORGANIZING ARTICLES IN A PURSE

FIELD OF THE INVENTION

The present invention relates to purses that are used to contain articles.

BACKGROUND OF THE INVENTION

Purses are used to contain and carry a wide variety of articles, such as keys, coins, paper money, cosmetics, etc. A purse is such a convenient place to put things that a user is likely to be indiscriminate in putting articles inside the purse. After some period of time has passed, the purse usually becomes quite full of articles.

A common problem with purses is the disorganization of these articles that are contained therein. After a purse becomes crowded with articles, it becomes difficult to find things. For example, keys are one type of articles that are frequently used. Once keys are placed back into the purse, it may be hours before they are needed again. In the meantime, the keys can work their down to the bottom of the purse, and be covered up by other articles. When the user of the purse wishes to retrieve the keys, it is frequently difficult to find them.

SUMMARY OF THE INVENTION

It is an object of the present invention to provide a system for organizing articles in a purse.

The present invention provides a purse that includes walls that form an enclosed cavity. The walls have an opening that communicate with the cavity. The purse also has a support member that is coupled to the walls. The support member has notches therein. There are plural holders located in the cavity. The holders hold the articles that are contained in the purse. Each holder has a line that has first and second ends. The first end of the line is coupled to the respective holder and the second of the end is connected to a stop. The stop is larger than a respective one of the notches in the support member. The line is received by one of the notches.

The present invention allows a user of a purse to maintain a wide variety of articles in that purse in an organized manner. The articles are organized by placing them on or in one or more holders. For instance, all credit cards can be contained in a credit card holder, while all keys can be placed in another holder or on a key ring. The holders themselves are organized within the purse. This is accomplished by providing each holder with a line, the free end of which has a stop. The line is received by a notch and a support member inside the purse. In one aspect of the invention, the holders are presented for easy access by a user due to the support member being located near the purse opening and the stops also being located near the purse opening.

In another aspect of the present invention, the support member is a card. The card has edges that are coupled to the purse walls. A top edge of the card has the notches formed therein.

In accordance with another aspect of the present invention, the support member is a tube, which tube has an opening therein so as to be "C"-shaped in transverse cross section. The tube has edges formed along the tube opening, with one of the tube edges having the notches therein.

The holders can be of various configurations. For example, a holder can be a bag, a wallet, a checkbook, or a key ring.

In still another aspect of the present invention, each one of the holders has a stop, with each stop being different than the other stops. The stops are differentiated from each other by tactile characteristics. Such tactile characteristics include the shapes of the stops. Alternatively, such tactile characteristics include the surface texture of the stops. In another aspect of the present invention, the stops are differentiated from each other by color.

By providing a unique stop for each holder, the user can identify the particular holder that is attached to the stop and retrieve that holder without having to look at the articles or the holders themselves.

In accordance with another aspect of the present invention, there is provided a purse that includes purse walls forming an enclosed purse cavity. The purse walls have a purse opening that communicates with the purse cavity. There are plural bags that are located in the purse cavity. Each of the bags includes bag walls that form an enclosed bag cavity, and a line. The bag walls have a bag opening that communicates with the bag cavity. The line has first and second ends. The first end of the line is coupled to one of the bag walls. The second end of the line has a fob located thereon. Each of the fobs is differentiated from each other by tactile characteristics.

In accordance with still another aspect of the present invention, each of the bags has a zipper to open and close the bag opening. Each zipper has a handle. The first end of the line is coupled to the zipper handle.

In still another aspect of the present invention, there is provided a method of locating a bag in a set of bags. Each of the bags in the set bags is provided with a fob connected thereto. The fobs are differentiated from each other by tactile characteristics. The fobs are felt to locate a desired one of the fobs. After locating the desired one of the fobs, the bag that is connected to the desired fob is accessed. The set of bags can be contained in a purse.

DESCRIPTION OF THE PREFERRED EMBODIMENTS

Figure 1:
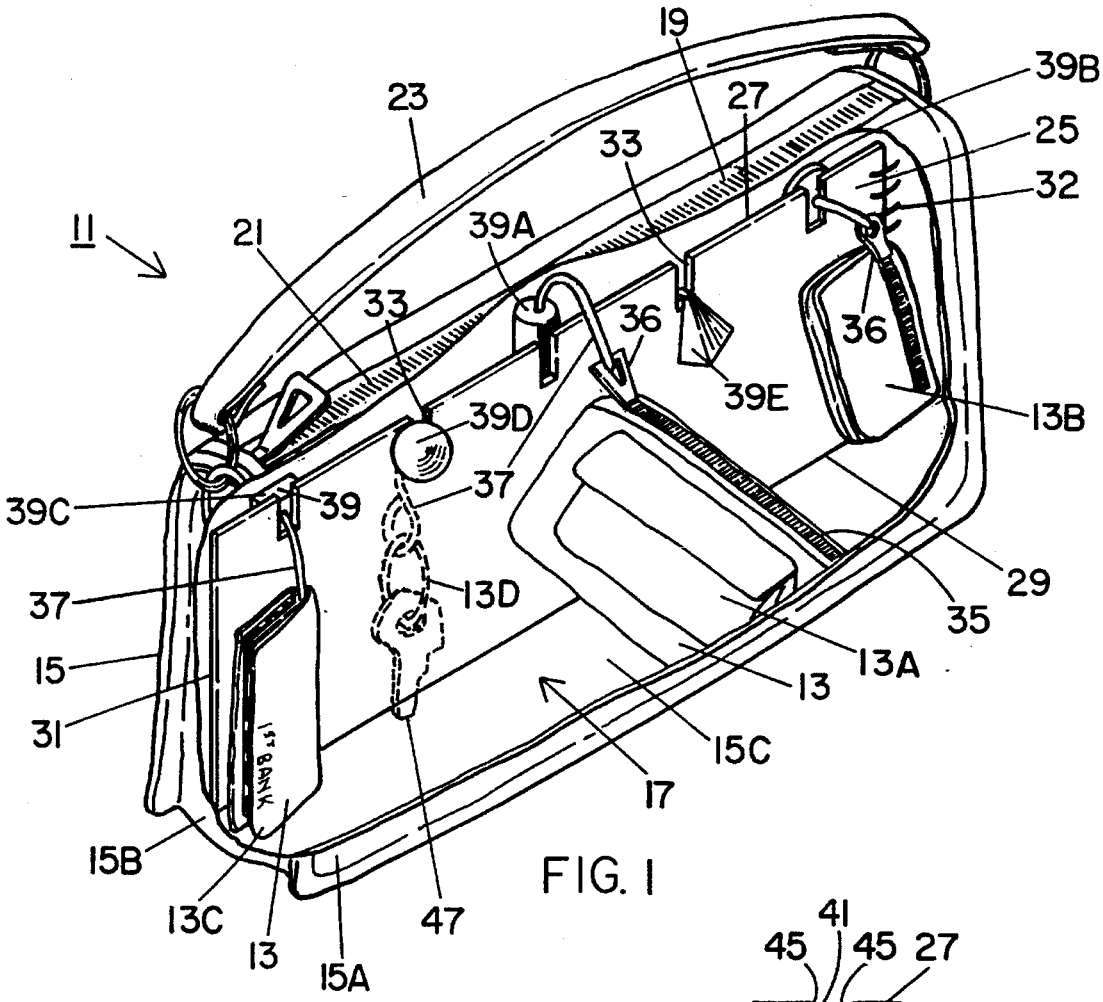
FIG. 1 is a isometric, partially cut away, view of a purse of the present invention, in accordance with a preferred embodiment.

In FIG. 1, there is shown the purse 11 of the present invention in accordance with one embodiment. The purse is of the type that can be used by a woman for carrying various articles such as keys, credit cards, money, cosmetics, etc.

The present invention provides plural holders 13 located inside of the purse. The articles in the purse are organized by the holders. For example, one holder is a bag and can contain keys. Another holder can contain money or credit cards. Still another holder can contain cosmetics.

The holders are supported inside of the purse so that each holder is readily accessible to the user of the purse.

In addition, the present invention provides a system of identification so as to enable the user of the purse to easily identify the individual holders and the contents thereof. For example, using the system of identification, the user of the purse can identify the holder containing the keys from the holder containing cosmetics.

A more specific description of the purse 11 will now be provided. The purse 11 has walls 15 that form an enclosed cavity 17. For the purse shown in FIG. 1, there are side walls 15A, two end walls 15B, and a bottom wall 15C. (In the description that follows, terms such as "bottom" and "top" are used with reference to the orientation of the purse as shown in FIG. 1.) The walls 15 of the purse can be made from a variety of materials, such as cloth, leather, plastic, etc. The walls 15 are joined (for example, by stitching) together so as to enclose the cavity 17. There is an opening 19 opposite the bottom wall 15C and in between the side walls. The opening has a zipper 21 for closure. The purse is also equipped with a handle 23.

There is a support member 25 located inside of the cavity 17. In the embodiment shown in FIG. 1, the support member is a card 25. The card is a flat rectangular member. The card 25 is made up of rigid plastic (although it can be made of other materials). The card 25 has top and bottom edges 27, 29 and end edges 31. The end edges 31 are coupled to the end walls 15B of the purse. For example, the card can be coupled to the purse walls by stitching 32. The card is centered in the cavity so that the top edge 27 is just beneath the zippered opening 19. The card can be long enough so that the bottom edge 29 bears on portions of the bottom wall 15C of the purse. However, the card bottom edge need not be in contact with the purse bottom.

The top edge 27 of the purse has plural notches 33 formed therein. Each notch 33 extends from the top edge 27 of the card toward the bottom edge 29.

Plural holders 13 are located within the cavity of the purse. The holders can have a variety configurations. In one configuration, a holder has walls that form a cavity for containing articles. Such a holder forms a bag 13 A or a small purse. The walls can be stiff (or semi-rigid) or flexible. There is an opening that communicates with the cavity. The opening can be closed by zipper 35, a draw string, a snap, or the like. In another configuration, a holder can be a pocketbook or wallet 13B, having two walls that are hinged together along an edge in each wall. To open the wallet, the walls are opened to reveal the interior. The wallet can have pockets therein that can be zippered or snapped closed. The wallet can also have transparent holders for credit cards or photographs. In still another configuration, a holder 13C can be a checkbook. In still another configuration, a holder 13D can be a key ring or chain, with keys 47 thereon.

Each holder 13 has a line 37 attached thereto. The line can be attached to the holder by stitching, tying or by using some adhesive. If the holder has a zipper, then preferably the line is attached to the handle 36 of the zipper. The line 37 secures the holder to the support member 25. The line can be a cord, chain, wire, etc. The line 37 extends from the holder for a short distance, for example for 0.5 to 3.0 inches. At the free end of the line is an enlargement 39 or stop or fob. The line 37 is sized so as to be received by a notch 33 in the card 25. However, the stop 39 is sized so as to be larger than the notch. The stop can simply be a knot in the end of the line. However, in the preferred embodiment, the stop is a bead or nodule that is coupled to the line. The bead may be of wood, plastic, metal or the like. To secure the line 37 to the bead, a hole is formed through the bead. The line is inserted through the hole, wherein the free end is enlarged or knotted to prevent the line from pulling back through the bead.

To utilize the purse 11 in the present invention, the user organizes the articles to be contained within the purse into the individual holders 13. For example, the user might place cosmetics into one bag 13A, keys on a key chain 13D or into a second bag, and credit cards into a third bag 13B. After the articles are organized into their respective holders, the user organizes the various holders within the purse. This is accomplished by placing the line 37 of each holder into a respective notch 33 in the top edge 27 of the card 25. Thus, the holder 13 is located on one side of the card 25, while the stop 39 is located on the other side of the card. Typically, the weight of the holder will pull down on the line so as to pull the stop 39 against the side of the notch 33. The stop prevents the line from pulling through the notch.

It is preferable to place only one line in each notch. Thus, the holders and their lines are located along the length of the card top edge 27. To further organize the holders, they can be placed on both sides of the card. For example, as shown in FIG. 1, a first holder 13C is located on one side of the card; a second holder 13D that utilities the notch adjacent to the first holder's notch is located on the opposite side of the card from the first holder; a third holder 13A that utilizes the notch adjacent to the second holder's notch is located on the same side of the card as the first holder; and so on in an alternating manner. If desired, a notch can contain two lines instead of just one.

When the user wishes to retrieve a particular holder 13, it is located and accessed. The holder can be accessed inside of the purse, wherein, if the holder is a bag or wallet, the user opens the holder and retrieves (or stores) articles therefrom. The holder can also be accessed by removing it from the purse. To remove the holder, the user merely takes hold of the stop 39 and pulls up, wherein the line is pulled out of the notch and the holder is pulled out of the purse. Alternatively, the user can take hold of the line and pull up to free the line from the notch. If the holder has a zipper, and the line is attached to the zipper handle 36, then the user can merely pull the line to pull the zipper open.

When a holder is returned to the purse, the line is reinstalled into the respective notch with the stop on one side of the notch and the holder on the other side. In dimly lit situations, the user can feel along the top edge 27 for an empty notch.

The present invention allows the user to easily identify a particular holder 13 from the other holders. This is accomplished by providing a stop 39 that is unique to a particular holder. For example, as shown in FIG. 1, one stop 39A has a cylindrical shape; another stop 39B has a disk or button shape; another stop 39C has a rectangular shape; another stop 39D has a spherical shape: still another stop 39E has a pyramidal or tetrahedral shape. Alternatively, the shape of the stop can emulate the shape of the articles in the holders. For example, the rectangle 39C can be used to indicate checks or checkbook 13C. The disk 39B can be used to indicate that coins are contained in the holder 13B. When the individual stops have unique shapes, the user is able to identify a particular holder by the feel of the stops 39. This is particular useful in poorly illuminated situations, where the user may be unable to see the contents of the purse. If the user knows that keys are stored in the holder with the spherical stop, the user need only locate the top edge 27 of the card by feeling the edge with a finger, and running the finger along the top edge, feeling the shape of the stops located adjacent to the top edge. When the appropriate stop is located by feel, then the stop and the respective holder can be removed.

The stops 39 can also be distinguished by surface texture. For example, the surface of one stop can be rough, while the surface of another stop is smooth. Also, the surface of a stop can have a unique pattern embossed thereon or formed within the surface.

The stops can also be distinguished with visual mechanisms. For example, different colors can be used so that one stop is red, another stop is yellow, another stop is blue, still another stop is green, and so on.

The stops can combine the above tactual and visual characteristics so that a user can distinguish the stops by both feeling and seeing.

In FIG. 1, the notches are shown as rectangular in shape. The notches can be other shapes as well. For example, referring to FIG. 3, the notches 33A could have a narrow neck 41 adjacent to the top edge 27 of the card. The neck 41 would communicate with a larger, more circular opening 43. The neck 41 is slightly smaller than the outside diameter of the line 37. The line is inserted into the narrow neck 41 and pulled or pressed down into the larger opening 43. The narrow neck 41 effectively prevents the line from exiting the notch. In addition, the notches have inclined surfaces 45 that merge with the top edge 27. These inclined surfaces allow a user to more easily feel the location of a notch as the user's finger is moved along the top edge.

Figure 2:
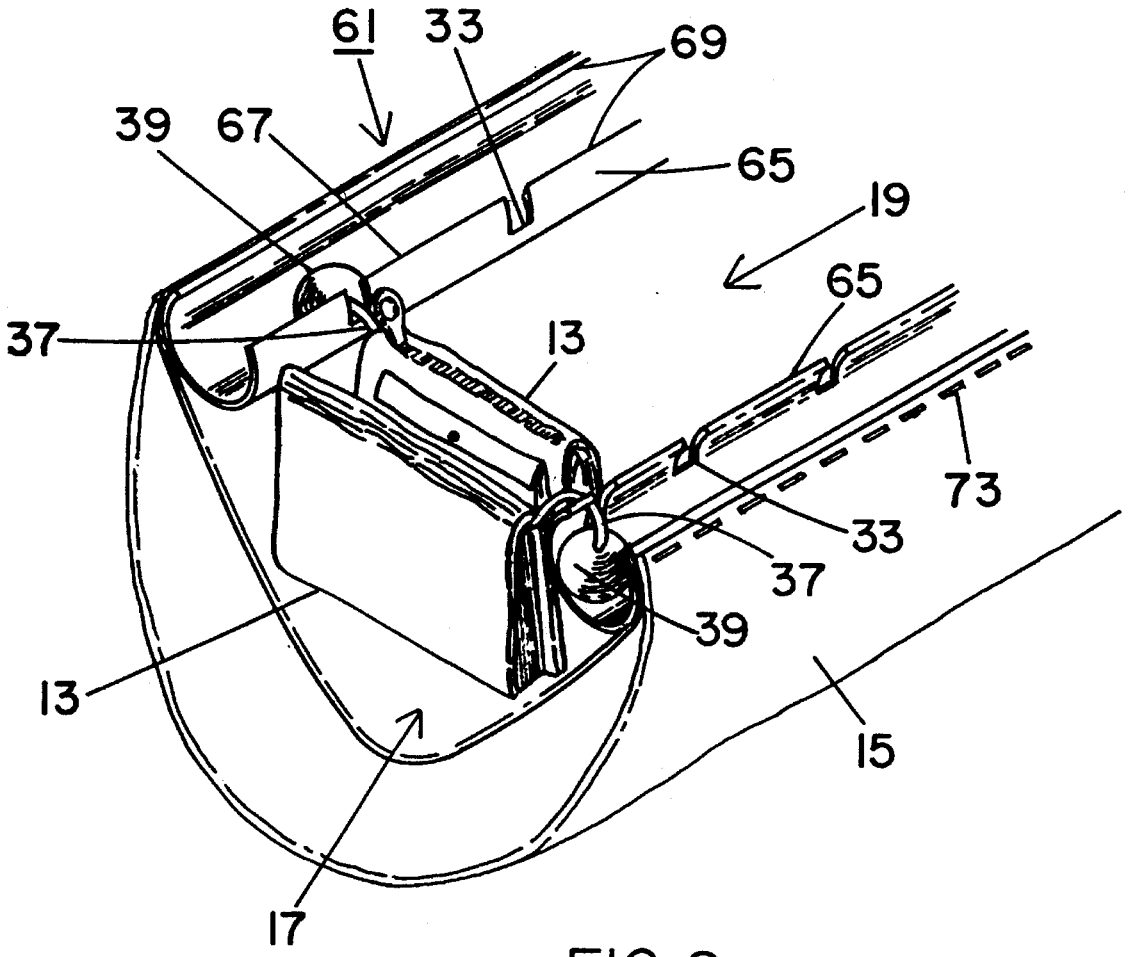
FIG. 2 is a isometric view of one end of an open purse, in accordance with another embodiment.

Another embodiment of the purse 61 is shown in FIG. 2. In this embodiment, the support member is one or more tubes 65, instead of a card. The purse 61 of FIG. 2 is similar to the purse 11 of FIG. 11, in that it has walls 15, a cavity 17, and an opening 19. The purse 61 shown in FIG. 2 is of a somewhat cylindrical shape. The tubes 65 are coupled to the purse near the opening to the cavity. In the preferred embodiment, the tubes are stitched 73 to the side walls of the purse. The tubes 65 can be made out of a rigid plastic material.

Each tube has a gap 67 or opening formed in the upper portion of the tube, which gap extends for the length of the tube. The gap 67 causes the tube to have a sideways "C" shape when viewed in transverse cross section. The gap forms two edges 69. The innermost edges have notches 33 formed therein along the length of the tube. The tubes can have cross-sectional shapes other than a "C".

There is a tube 65 located along each side of the opening. The gap 67 and the top portion of each tube is sized so as to allow the stops 39 to pass therethrough. However, the stops 39 are too big to pass through the notches 71.

To use the purse 61 of FIG. 2, a user locates holders 13 inside the purse cavity 17 and places the stops 39 inside of the respective tubes 65 through the respective gap 67. The users locates the lines 37 in the respective notches 33. The holders can be arranged below the tubes and in a parallel relation with the tubes in order to allow closure of the opening 19. (In FIG. 2, the holders are shown as oriented perpendicular to the tubes for illustrative purposes.) The holders are removed as described above with respect to FIG. 1. The stops 39 can be unique in both tactual and visual characteristics so as to allow identification of a particular holder.

Figure 3:
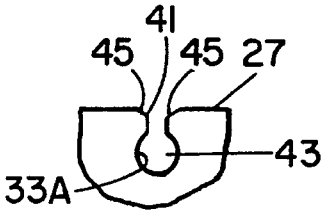
FIG. 3 is a view of a notch, in accordance with another embodiment.

The notch arrangement of FIG. 3 can be used with the embodiment of FIG. 2.

If the stops are individually unique, the bags need not be coupled to a support member inside of a purse. The stops or fobs 39 are differentiated from each other by tactile characteristics that are used to locate individual bags. For example, the bags can be contained inside of a purse. In low light situations, the user feels each fob 39 to identify that particular bag. When the appropriate fob and bag are found, the user accesses the bag.

Figure 4:
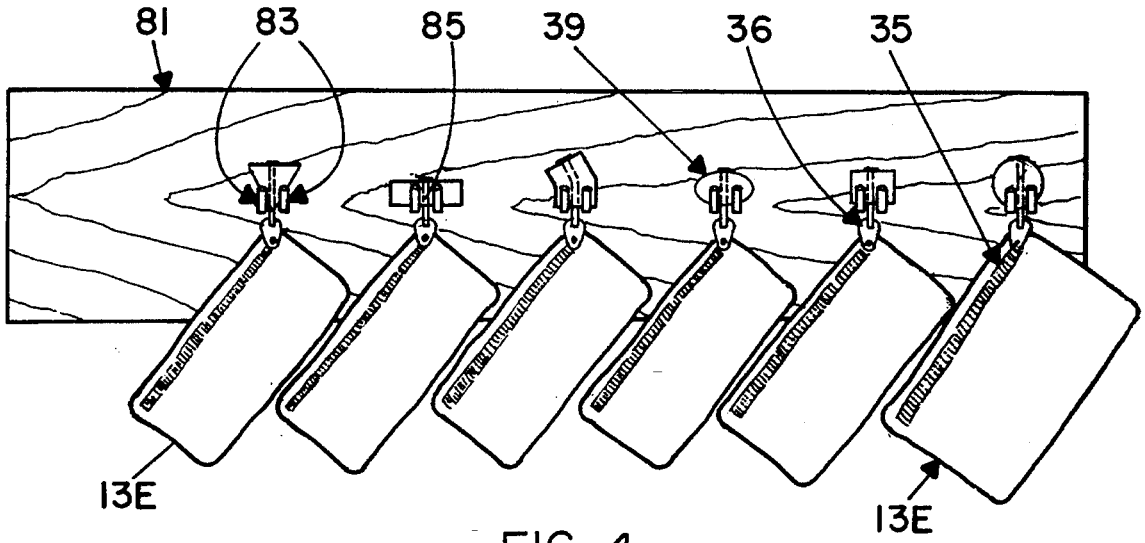
FIG. 4 is a front elevational view of a display arrangement for supporting bags.
Figure 5:
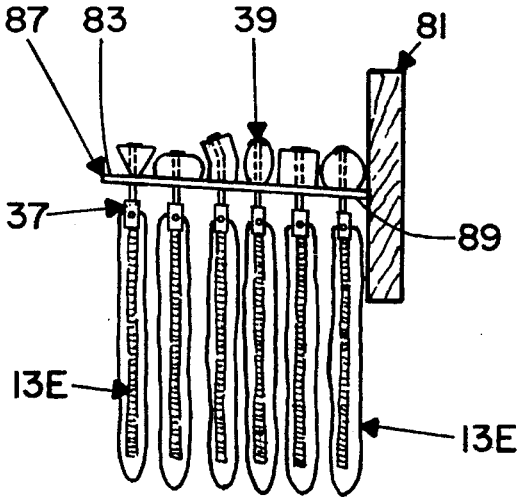
FIG. 5 is a side elevational view of the display arrangement of FIG. 4.

This same system of using unique fobs to identify one bag out of a plurality of bags can also be used in situations not involving a purse. For example, the individual bags 13E can be displayed in a store or hung in a closet. Referring to FIGS. 4 and 5, the fobs are used to suspend the individual bags. The figures show a typical support arrangement which includes a base 81 which is secured to a wall or a display. Rods 83 extend horizontally out from the board. The rods are in pairs, with the rods in each pair being separated from each other by a small gap 85. The free ends 87 of the rods are raised above the fixed ends 89, so as to prevent the purses from sliding off of the rods. The bags 13E are hung from the rods 83 by inserting the line 37 into the gap. The fobs 39 or stops bear on the rods.

The bags 13E can be organized so that all spherical fobs are located on one rod pair, all square fobs are located on another pair of rods and so on. However, as shown in FIG. 5, the bags can be organized with one rod pair containing a variety of fob shapes.

The individual bags can be found by feeling or looking at the fobs. Such a display arrangement can be used to obtain replacement bags for those bags that are contained in a purse, Thus, the bags need not contain any articles when displayed in this manner. Such a display is particularly well suited for persons with poor eyesight, who can identify the individual bags by feeling the fobs.

The foregoing disclosure and showings made in the drawings are merely illustrative of the principles of this invention and are not to be interpreted in a limiting sense.

I claim:

1. A purse, comprising:

walls forming an enclosed cavity, said walls having an opening that communicates with said cavity;

a support member coupled to said walls, said support member having notches therein, said notches being located adjacent to said opening and being opened toward said opening;

plural holders located in said cavity;

for each holder, a flexible line having first and second ends, with said first end being coupled to said respective holder and said second end being connected to a stop, said stop being larger than a respective one of said notches, said line being received by said one of said notches such that said holder is located on one side of said one notch and said stop is located on an opposite side of said one notch.

2. The purse of claim 1, wherein said support member comprises a card, said card having ends and an edge that extends between said ends, said ends of said card being coupled to said walls, said edge having said notches therein, said edge being located near said opening.

3. The purse of claim 2, wherein said edge of said card is a first edge, said card having a second edge that bears on a bottom wall of said purse.

4. The purse of claim 1, wherein said support member is a tube, said tube having an opening therein, wherein edges are formed along said tube opening, with one of said tube edges having said notches.

5. The purse of claim 1, wherein said stops are differentiated from each other independently of location so that each stop is unique.

6. The purse of claim 5, wherein said stops are differentiated from each other by tactile characteristics.

7. The purse of claim 6, wherein said tactile characteristics comprise shapes of said stops.

8. The purse of claim 6, wherein said tactile characteristics comprise surface texture of said stops.

9. The purse of claim 5, wherein said stops are differentiated from each other by color.

10. The purse of claim 1, wherein said holders comprise bags.

11. The purse of claim 1, wherein said holders comprise a wallet.

12. The purse of claim 1, wherein said holders comprise a checkbook.

13. The purse of claim 1, wherein said holders comprise a key ring.

14. The purse of claim 1, wherein said notches are formed in an edge of said support member, said notches having inclined surfaces that merge with said edge.

15. The purse of claim 1 wherein said support member has a first side and a second side, with at least one of said holders being located on said first side and at least another of said holders being located on said second side.

16. The purse of claim 1 wherein each of said notches comprises a neck and a support opening, said neck extending from an edge of said support member to said support opening, said neck having a width that is less than an outside diameter of said line and a diameter of said support opening.

17. A set of bags for containing articles, comprising:

each of said bags comprising:

walls forming an enclosed cavity, said walls having an opening that communicates with said cavity;

a line having first and second ends, said first end of said line being coupled to one of said walls, said second end of said line having a fob located thereon;

at least several of said bags having fobs that are unique, said unique fobs being differentiated from each other by tactile characteristics.

18. The set of bags of claim 17, wherein said tactile characteristic comprise shapes of said fobs.

19. A purse, comprising:

purse walls forming an enclosed purse cavity, said purse walls having a purse opening that communicates with said purse cavity;

plural bags located in said purse cavity, each of said bags comprising:

bag walls forming an enclosed bag cavity, said bag walls having a bag opening that communicates with said bag cavity;

a line having first and second ends, said first end of said line being coupled to one of said bag walls, said second end of said line having a fob located therein;

each of said fobs being differentiated from each other by tactile characteristics.

20. The purse of claim 19, wherein each of said bags further comprises:

said bag opening being opened and closed by a zipper, said zipper having a handle;

said first end of said line being coupled to said zipper handle.

* * * * *